United States Patent [19]

Alden

[11] Patent Number: 5,050,768

[45] Date of Patent: Sep. 24, 1991

[54] REFUSE RECYCLING ORGANIZER CONTAINER

[76] Inventor: Rory W. Alden, 1736 Blake St., Berkeley, Calif. 94703

[21] Appl. No.: 527,854

[22] Filed: May 24, 1990

[51] Int. Cl.[5] ..... B65D 1/24

[52] U.S. Cl. ..... 220/551; 220/909; 220/533

[58] Field of Search ..... 220/551, 552, 533, 532, 220/909

[56] References Cited

U.S. PATENT DOCUMENTS

| | | | |
|---|---|---|---|
| 367,981 | 8/1887 | Hodge | 220/551 |
| 560,893 | 5/1896 | Conant | 220/551 |
| 990,319 | 4/1911 | Walton | 220/551 |
| 2,161,624 | 6/1939 | Hoerr | 220/551 |
| 2,743,774 | 5/1956 | Pinto | 220/551 |
| 2,895,782 | 7/1959 | Fragale | 220/909 |
| 3,410,445 | 11/1968 | Pilley | 220/533 |
| 3,656,650 | 4/1972 | Frater | 220/533 |
| 4,113,125 | 9/1978 | Schiller | 220/909 |
| 4,308,953 | 1/1982 | Cohen | 220/533 |
| 4,453,634 | 6/1984 | Blumenthal | 220/353 |
| 4,574,950 | 3/1986 | Koe et al. | 220/532 |
| 4,807,760 | 2/1989 | Sussman | 220/533 |
| 4,884,689 | 12/1989 | Su-Chin | 220/533 |
| 4,889,253 | 12/1989 | Schmulian et al. | 220/551 |
| 4,974,746 | 12/1990 | Dickinson | 220/404 |

FOREIGN PATENT DOCUMENTS

| | | | |
|---|---|---|---|
| 3642734 | 6/1988 | Fed. Rep. of Germany | 220/909 |

*Primary Examiner*—Stephen Marcus
*Assistant Examiner*—S. Castellano
*Attorney, Agent, or Firm*—Leon Gilden

[57] ABSTRACT

Container structure including spaced and parallel forward and rear walls and spaced and parallel side walls to define a container with a lid removably mounted thereon. The forward and rear walls include spaced parallel slots to selectively receive divider walls therebetween. The organization is arranged to utilize castor wheels for mobility and optionally utilize adjustable wall portions for longitudinal division of the container.

2 Claims, 4 Drawing Sheets

PRIOR ART 10
17
17a
17a
18
12
20
13
18
19
17a
23
21
23
14
11
23
19a
22
20
19
23
28
16
16

REFUSE RECYCLING ORGANIZER CONTAINER

BACKGROUND OF THE INVENTION

1. Field of the Invention

The field of the invention relates to container organizations, and more particularly pertains to a new and improved refuse recycling organizer container wherein the same utilizes compartments arranged to accommodate various catagories of recycling articles.

2. Description of the Prior Art

Contemporary society requires recycling of various components such as paper, aluminum cans, glass bottles, plastic and the like. These catagories of components are typically disposed of by conventional households in catagories such as 43 percent for paper, 18 percent for glass, 17 percent for polymerics, 12 percent for metals, and 10 percent for miscellaneous components such as fabric, fiberglass, organic wastes, and the like.

To accommodate these various components and to provide discrete storage for each of such components to permit recycling and disposal thereof, the instant invention attempts to overcome deficiencies of the prior art to provide compartments arranged in approximation of the percentage breakdown for the various components. Further inasmuch as such components may vary from household to household, the compartments devised by the instant invention are adjustable to accommodate variation of disposal of various items between households. Examples of prior art containers are set forth in U.S. Pat. No. 4,834,253 to CRINE for example wherein a recycling container unit utilizes a trio of generally pie shaped containers mounted within a central housing for disposal of various items therewithin.

U.S. Pat. No. 3,904,218 to KOSTIC sets forth a trash disposal unit with a platform movably mounted and supporting a series of four quadrant container chutes.

U.S. Pat. No. 4,739,894 to PENDER sets forth a compartmentalized container organization for trash disposal.

U.S. Pat. No. 4,646,628 to LADERMAN utilizes a cooking utensil illustrating the use of various removable chambers from within a central cooking pot.

U.S. Pat. No. 4,775,066 to KEPPELER sets forth an in ground trash receptacle for temporary storage of disposable and reclaimable items that is partially buried to prevent access to such components by scavengers, insects, and the like.

Accordingly, it may be appreciated that there continues to be a need for a new and improved refuse recycling organizer container as set forth by the instant invention which addresses both the problems of ease of use as well as effectiveness in construction in compartmentalizing and selectively providing adjustment for various components of recyclable refuse.

SUMMARY OF THE INVENTON

In view of the foregoing disadvantages inherent in the known types of refuse containers present in the prior art, the present invention provides a new and improved refuse recycling organizer container wherein the same utilizes selectively adjustable compartments within a central container to accommodate various catagories of refuse therewithin. As such, the general purpose of the present invention, which will be described subsequently in greater detail, is to provide a new and improved refuse recycling organizer container which has all the advantages of the prior art refuse containers and none of the disadvantages.

To attain this, the refuse recycling organizer container of the instant invention includes container structure including spaced and parallel forward and rear walls and spaced and parallel side walls to define, a container with a lid removably mounted thereon. The forward and rear walls include spaced parallel slots to selectively receive divider walls therebetween. The organization is arranged to utilize castor wheels for mobility and optionally utilize adjustable wall portions for longitudinal division of the container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention.

It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refuse recycling organizer container which has all the advantages of the prior art refuse containers and none of the disadvantages.

It is another object of the present invention to provide a new and improved refuse recycling organizer container which may be easily and efficiently manufactured and marketed.

It is a further object of the present invention to provide a new and improved refuse recycling organizer container which is of a durable and reliable construction.

An even further object of the present invention is to provide a new and improved refuse recycling organizer container which is susceptible of a low cost of manufacture with regard to both materials and labor, and which accordingly is then susceptible of low prices of sale to the consuming public, thereby making such refuse recycling organizer containers economically available to the buying public.

Still yet another object of the present invention is to provide a new and improved refuse recycling organizer container which provides in the apparatuses and methods of the prior art some of the advantages thereof, while simultaneously overcoming some of the disadvantages normally associated therewith.

Still another object of the present invention is to provide a new and improved refuse recycling organizer container which may be compactly stored when not being utilized.

Yet another object of the present invention is to provide a new and improved refuse recycling organizer container wherein the same provides adjustable compartments to accommodate variations of disposable refuse between various households in accordance with that household's needs for compartmentalizing various recyclable refuse components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
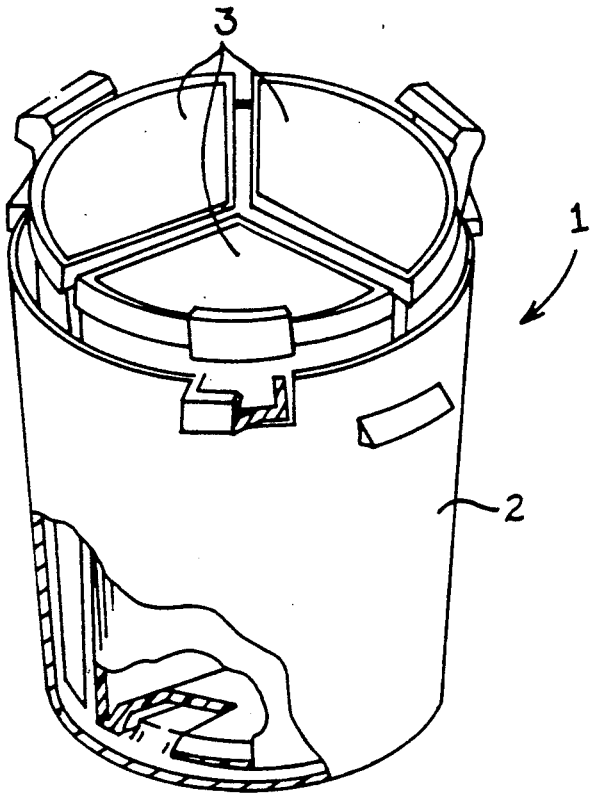
FIG. 1 is an isometric illustration of a prior art refuse container.

With reference now to the drawings, and in particular to FIGS. 1 to 6 thereof, a new and improved refuse recycling organizer container embodying the principles and concepts of the present invention and generally designated by the reference numeral 10 and 10*a* will be described.

Figure 2:
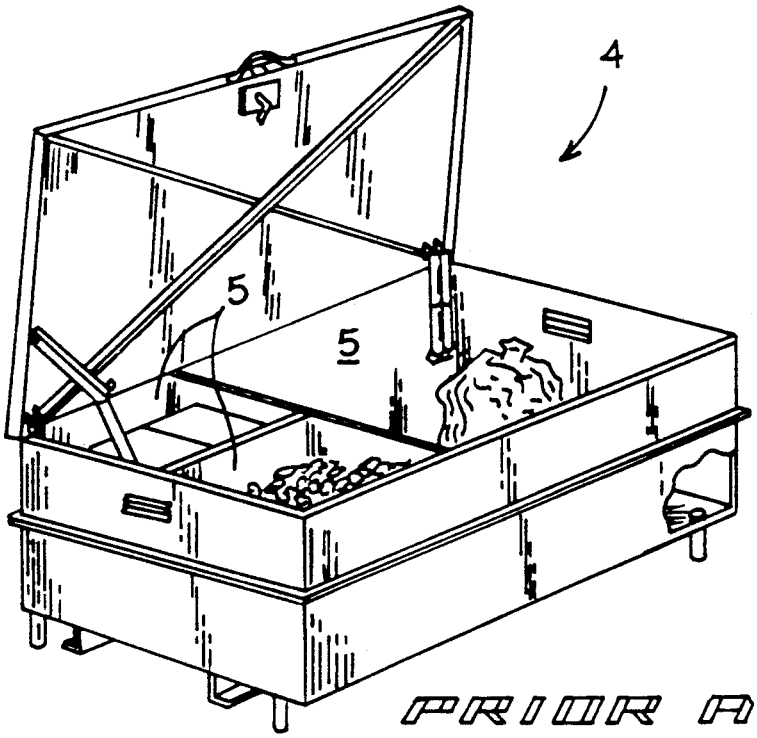
PRIOR ART FIG 2
FIG. 2 is a further example in isometric illustration of a refuse container or the prior art.

FIG. 1 illustrates a prior art refuse container 1 wherein a central container housing 2 includes a trio of pie shaped refuse container selectively receivable and removable from the container 2. FIG. 2 illustrates a further storage container 4 utilizing various compartments 5 of a fixed relationship interiorly of the container for temporary burial during a camping procedure and the like for temporary storage of refuse preventing access thereto by vermin, insects, and the like.

More specifically, the refuse recycling organizer container 10 of the instant invention comprises, a container defined by a forward wall 11 spaced from and parallel to a rear wall 12. A first side wall 13 is spaced from and parallel to a second side wall 14 with the walls orthogonally mounted to a floor 15 to define the rigid container. Castor wheels 16 are mounted at each corner of the floor to permit mobility of the organization. It is contemplated that the container as defined be dimensioned for positioning within a kitchen environment as a substitute for a trash compactor and the like to thereby provide organizational compartments for storage of various catagories of recyclable refuse. A lid 17 is illustrated utilizing spaced hinges 18 to mount the lid to the rear wall 12 but alternatively that it is contemplated that the lid be removable relative to the wall structure to permit access to the interior compartments of the container. Accordingly various members such as spring clamps or positioning pegs such as the pegs 17*a* as illustrated be utilized to provide registration of the lid relative to the container.

Figure 3:
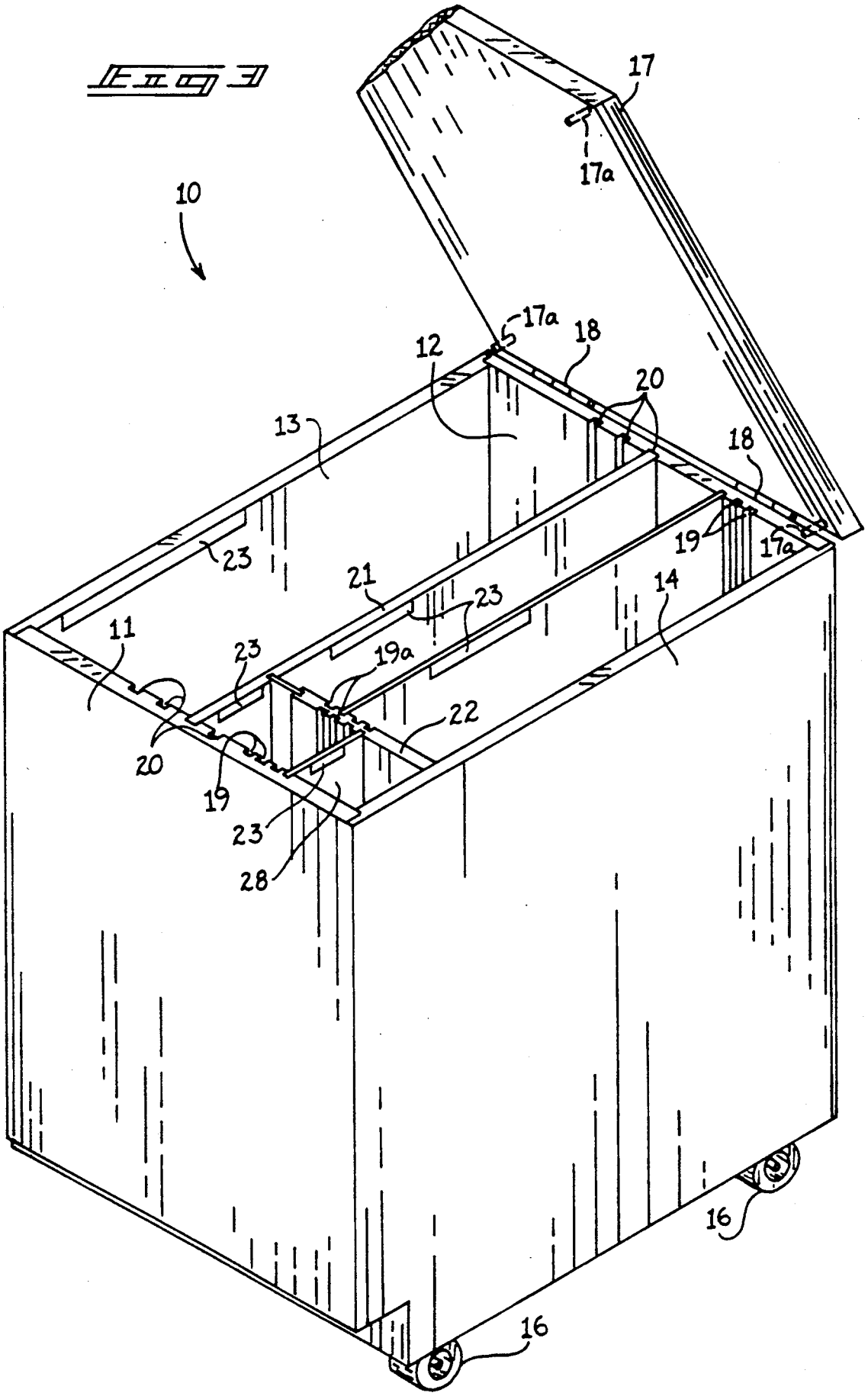
FIG. 3 is an isometric illustration of the instant invention.
Figure 4:
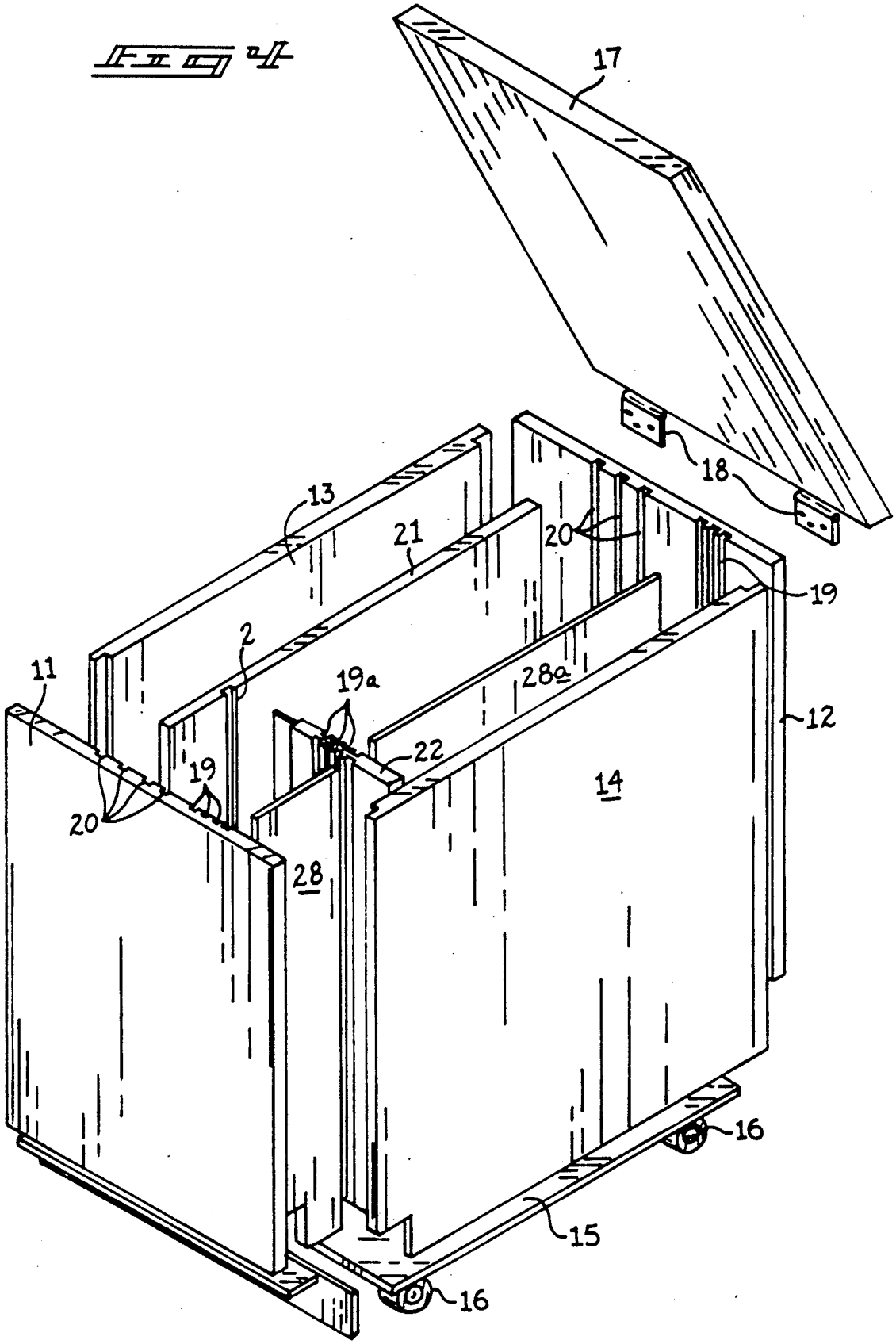
FIG. 4 is an isometric illustration somewhat exploded of the instant invention.
Figure 5:
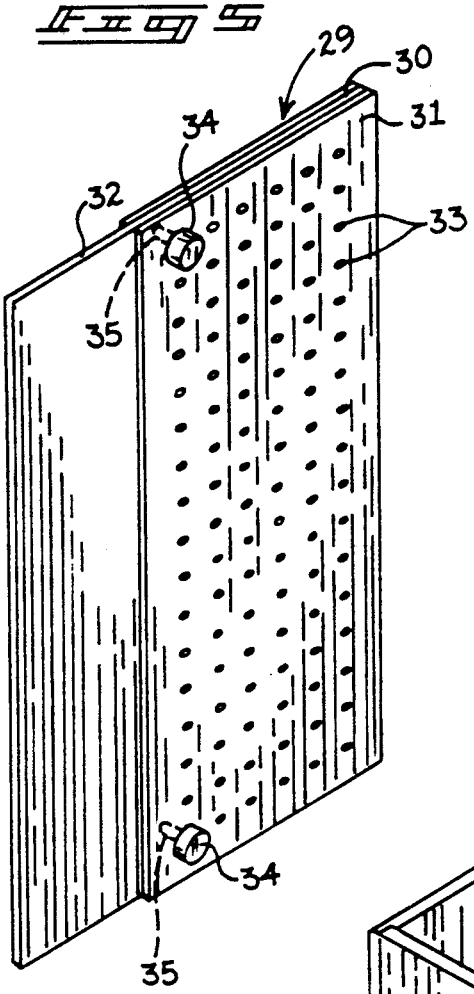
FIG. 5 is an isometric illustration of a modified divider wall utilized by the instant invention.

The interior surface of the forward wall 11 is defined by a series of slot groups defining a series of first slots 19 defined by a first width and a series of second slots 20 defined by a second width greater than that of the first width. The first and second slots are also formed to an interior surface of the rear wall 12 in alignment with corresponding first slots of the forward wall 11. The aligned slots permit reception of various divider panels in an adjustable manner interiorly of the container. Specifically, a first longitudinal panel 21 defined by a width equal to the second width is selectively receivable within one of the second pairs of aligned slots 20 formed within the forward and rear wall. A lateral panel 22 is orthogonally oriented relative to the second wall 14 and received within a corresponding longitudinal panel slot 21*a* aligned with a forward edge of the lateral panel 22. The lateral panel 22 is formed with further first slots 19*a* formed on each side of the lateral panel wherein each of the individual further first slots 19*a* are aligned with corresponding and confronting first slots 19 formed on the respective forward and rear walls 11 and 12 as illustrated to permit reception of first cross panel 28 selectively mounted between the forward wall 11 and the lateral panel 22 and a second cross panel 28*a* mounted between the lateral panel 22 and the rear wall 12. Further, as illustrated in FIG. 3, polymeric label strips 23 are provided adjacent each upper edge of each compartment defined by each of the panels within the wall structure of the container to permit convenient labeling of various catagories of recyclable refuse to be provided within each of the compartments.

Figure 6:
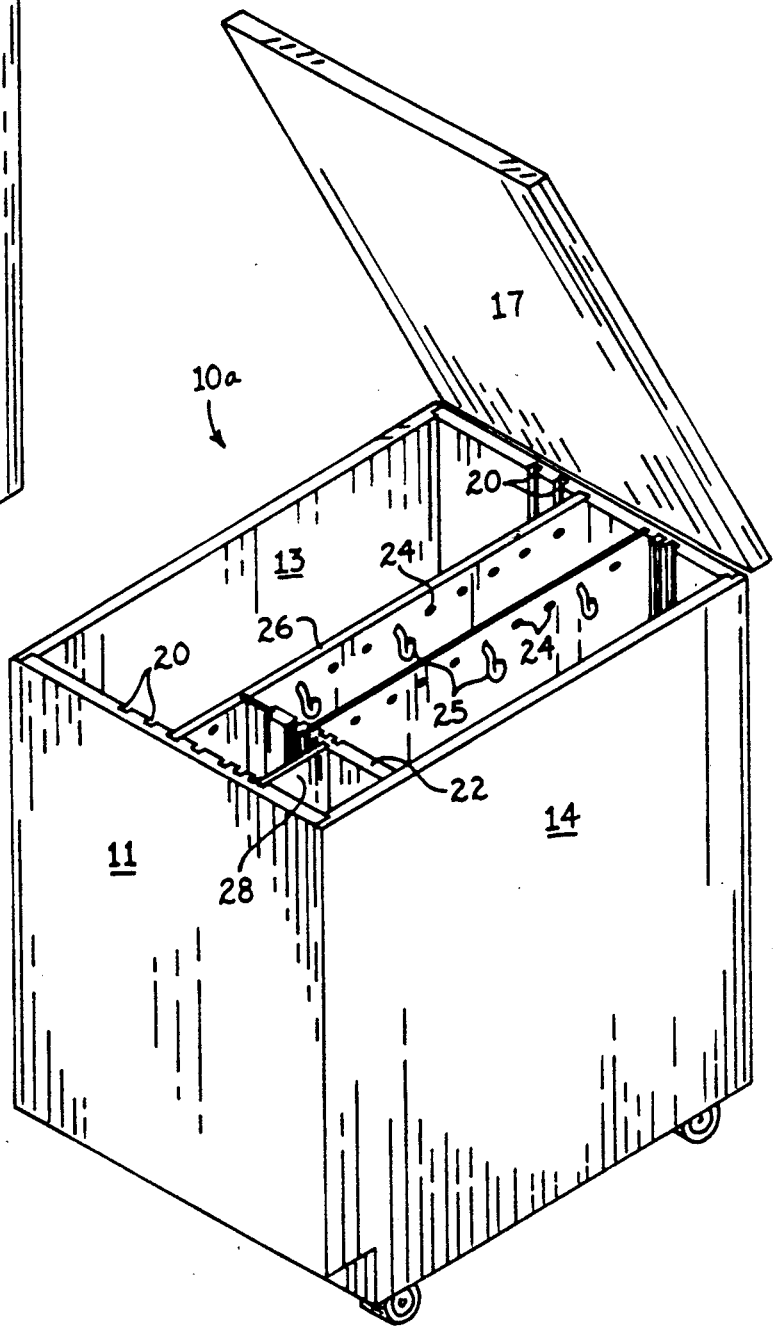
FIG. 6 is an isometric illustration of a modified refuse container of the instant invention utilizing various latches and the like for support of component bags mounted within the container.

Reference to FIG. 6 illustrates a modified container structure 10*a* wherein modified longitudinal panels 26 are utilized including a series of hooks 25 positioned within apertures 24 formed through each of the modified longitudinal panels 26 to assist in securement of various bag structures such as polymeric bags for reception of various catagories of refuse components as noted within each of the compartments. Further, a further longitudinal panel 29 (see FIG. 5) may be positioned between the modified longitudinal panel 26 and the second wall 14 as well as utilized in providing a panel for securement between spaced and aligned second slots 20.

The further longitudinal panel 29 is defined by a first planar apertured panel 30 including a matrix of rows and columns of apertures 33 therethrough spaced from and parallel to a second apertured panel 31 comprising a matrix of apertures 33 aligned with a matrix of apertures 33 within the first panel. Accordingly in this manner, plug members 34 are directed through selective apertures within a single column of apertures to provide an abutment surface for reception of a slide panel 32 complementarily received between the spaced first and second apertured panels 30 and 31. In this manner, the effective length of the further longuitudinal panel 29 is adjustable to accommodate various positions of the longitudinal panel 26 or 21 utilized within a container structure. The plug members 34 are of a relatively resilient construction to permit effective anchoring within an aligned pair of apertures defined between the first and second apertured panels 30 and 31 and including a shank portion 35 to be directed therethrough to proivde the abutment surface in the spacing between the first and second apertured panels 30 and 31.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A refuse organizing container comprising, a container defined by a forward wall spaced from and parallel a rear wall, and a first side wall spaced from and parallel a second side wall, and each wall orthogonally mounted to a floor defined of the container, the container including a plurality of compartments therewithin, and at least one longitudinal panel mounted between the forward wall and rear wall, the forward and rear walls including slot means formed within the forward and rear walls for selectively receiving the at least one longitudinal panel adjustably between the forward wall and rear wall, and wherein the slot means include a first series of slots formed within and vertically aligned with an interior surface of the forward wall and the rear wall, the first series of slots of the forward and rear walls aligned relative to one another, and the slot means further including a second series of slots formed within and vertically aligned with interior surfaces of the forward and rear walls wherein the second series of slots within the forward and rear walls are aligned relative to one another wherein the second series of slots adjustably receive the at least one longitudinal panel therebetween, and including a lateral panel mounted orthogonally between the second side wall and the at least one longitudinal panel, the lateral panel including a further first series of slots, the further first series of slots mounted coextensively within each side of the lateral panel and wherein the further first series of slots are aligned with the first series of slots of the forward wall and the rear wall, and including a first cross panel mounted between the first series of slots of the forward wall and confronting the further first series of slots of the lateral panel, and a second cross panel mounted within one of said further first series of slots of said lateral panel and one of said first series of slots of said rear wall wherein the first cross panel and the second cross panel are adjustably mounted within selective aligned pairs of said first and further first series of slots between the forward wall and lateral panel or between the rear wall and lateral panel, and including a lid selectively mounted overlying the container, the lid including peg means mounted to a bottom surface of the lid to position the lid to the container, and at least one further longitudinal panel positionable within the second series of slots includes a first apertured panel spaced from and parallel to a seconc apertured panel defined by a predetermined spacing and a slide panel defined by a predetermined thickness substantially equal to the predetermined spacing complementarily received therewithin, and the first and second apertured panels include aligned rows and columns of apertures therethrough wherein a plurality of plug members are selectively positionable within aligned apertures of the first and second apertured panels to define an abutment to abut an interior edge of the slide panel to permit selective positioning of the slide panel between the first and second apertured panels.

2. A container as set forth in claim 1 including a plurality of hook members selectively positionable within said apertures of the apertured panels to accommodate articles positioned thereon.

* * * * *